US009690245B2

(12) United States Patent
Harada

(10) Patent No.: US 9,690,245 B2
(45) Date of Patent: Jun. 27, 2017

(54) RECORDING MEDIUM BINDING APPARATUS, RECORDING MEDIUM ALIGNING APPARATUS, AND IMAGE FORMING SYSTEM

(71) Applicant: FUJI XEROX CO., LTD., Minato-ku, Tokyo (JP)

(72) Inventor: Katsunori Harada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 174 days.

(21) Appl. No.: 14/799,700

(22) Filed: Jul. 15, 2015

(65) Prior Publication Data

US 2016/0214825 A1 Jul. 28, 2016

(30) Foreign Application Priority Data

Jan. 23, 2015 (JP) ..... 2015-011186

(51) Int. Cl.
*G03G 15/00* (2006.01)

(52) U.S. Cl.
CPC ..... *G03G 15/6541* (2013.01)

(58) Field of Classification Search
CPC ..... B41F 13/64; B41F 13/60; B41J 13/54; G03G 15/6544
USPC ..... 270/1.01
See application file for complete search history.

(56) References Cited

U.S. PATENT DOCUMENTS 4,891,681 A * 1/1990 Fiske ..... B42C 1/12 270/37
2010/0258017 A1* 10/2010 Kersey ..... B26D 1/245 101/227
2013/0193628 A1* 8/2013 Itogawa ..... B41J 13/0036 270/1.01

FOREIGN PATENT DOCUMENTS

JP 2005-015225 A 1/2005

* cited by examiner

*Primary Examiner* — Jennifer Simmons
(74) *Attorney, Agent, or Firm* — Sughrue Mion, PLLC

(57) ABSTRACT

A recording medium binding apparatus include a cutting unit that is capable of cutting a first end and a second end of each of recording media; a transport unit that transports the recording media; a stacking unit on which the recording media are stacked; a recording medium aligning unit that aligns the recording media by pressing each recording medium by coming into contact with the first end and the second end of the recording medium every time the recording medium is stacked on the stacking unit, the recording medium aligning unit changing an operation of coming into contact with and separating from the recording medium when pressing the recording medium according to whether the recording medium has been cut or the recording medium has not been cut; and a binding unit that binds a recording medium stack formed by stacking the recording media aligned by the recording medium aligning unit.

13 Claims, 9 Drawing Sheets

RECORDING MEDIUM BINDING APPARATUS, RECORDING MEDIUM ALIGNING APPARATUS, AND IMAGE FORMING SYSTEM

CROSS-REFERENCE TO RELATED APPLICATIONS

This application is based on and claims priority under 35 USC 119 from Japanese Patent Application No. 2015-011186 filed Jan. 23, 2015.

BACKGROUND

Technical Field

The present invention relates to a recording medium binding apparatus, a recording medium aligning apparatus, and an image forming system.

SUMMARY

According to an aspect of the present invention, a recording medium binding apparatus includes a cutting unit that is capable of cutting a first end and a second end of each of recording media, the second end facing the first end; a transport unit that transports the recording media; a stacking unit on which the recording media transported by the transport unit are stacked; a recording medium aligning unit that aligns the recording media by pressing each recording medium by coming into contact with the first end and the second end of the recording medium every time the recording medium is stacked on the stacking unit, the recording medium aligning unit changing an operation of coming into contact with and separating from the recording medium when pressing the recording medium according to whether the recording medium has been cut or the recording medium has not been cut; and a binding unit that binds a recording medium stack formed by stacking the recording media aligned by the recording medium aligning unit.

BRIEF DESCRIPTION OF THE DRAWINGS

An exemplary embodiment of the present invention will be described in detail based on the following figures, wherein.

DETAILED DESCRIPTION

Description of Image Forming System 100

Hereinafter, an exemplary embodiment of the present invention will be described with reference to the drawings.

Figure 1:
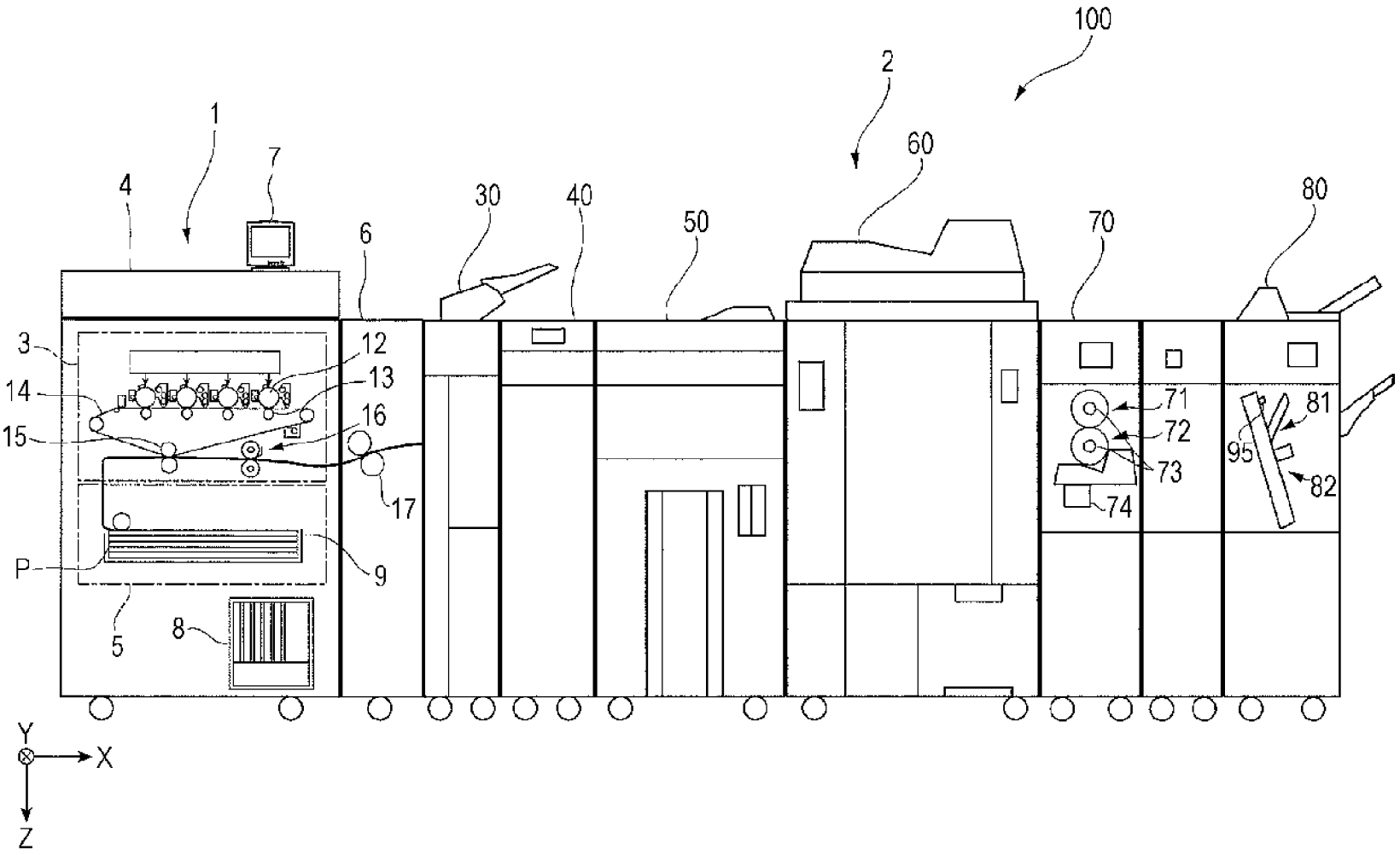
FIG. 1 illustrates an example of the overall structure of an image forming system according to the present exemplary embodiment.

FIG. 1 illustrates the overall structure of an image forming system 100 according to the present exemplary embodiment. FIG. 1 is a front view of the image forming system 100 as viewed from a front side F of the figure, from which the image forming system 100 receives instructions or operations from a user. The image forming system 100 includes an image forming apparatus 1 that forms an image on a sheet P, which is an example of a recording medium; and a postprocessing apparatus 2 that performs postprocessing, such as binding, on the sheet P on which the image is formed by the image forming apparatus 1.

The image forming apparatus 1, which has a so-called tandem structure, includes an image forming unit 3 and an image scanning unit 4. The image forming unit 3 forms an image on the basis of color image data. The image scanning unit 4 scans an image of a document and generates scanned image data that is used to form an image in the image forming unit 3. The image forming apparatus 1 further includes a sheet feeding unit 5, a sheet transport unit 6, an operation input unit 7, and an image forming apparatus controller 8. The sheet feeding unit 5 includes a sheet tray 9 for holding a sheet P and supplies the sheet P to the image forming unit 3. The sheet transport unit 6 transports the sheet P, on which the image is formed, to the postprocessing apparatus 2 by using a transport roller 17. The operation input unit 7 receives an operation input from a user. The image forming apparatus controller 8 controls the operation of the image forming apparatus 1.

The postprocessing apparatus 2 includes an interleaving sheet supply unit 30, a punching unit 40, a sheet stacking unit 50, and a case binding unit 60. The interleaving sheet supply unit 30 supplies an interleaving sheet. The punching unit 40 forms a hole in (punches) the sheet P. The sheet stacking unit 50 forms a sheet stack by stacking the sheets P. The case binding unit 60 applies an adhesive to a back portion (edge) of the sheet stack and performs case binding. The postprocessing apparatus 2 further includes a sheet cutting unit 70 and a finisher unit 80. The sheet cutting unit 70 cuts a first end and a second end of the sheet P, the first and second ends being ends in a direction (width direction) that crosses the transport direction. The finisher unit 80 aligns the sheet P at a predetermined position every time the sheet P is transported, and binds an end portion or a central portion of a sheet stack that is formed by stacking a necessary number of sheets P that are aligned. The sheet cutting unit 70 and the finisher unit 80 will be described below in detail.

In the following description, regarding the image forming system 100, a downward direction will be referred to as the Z direction, a direction from the front side F toward the rear side R in the figures will be referred to as the Y direction, and a direction that intersects the Y direction and that extends from the left side toward the right side as seen from the front side F will be referred to as the X direction.

Description of Image Forming Apparatus 1

Next, the image forming unit 3 of the image forming apparatus 1 will be described.

The image forming unit 3 according to the present exemplary embodiment includes four photoconductor drums 12 and four first transfer rollers 13. The photoconductor drums 12, which correspond to black (K), yellow (Y), magenta (M), and cyan (C), are arranged in the horizontal direction. The first transfer rollers 13 are arranged so as to correspond to the photoconductor drums 12. The image forming unit 3 further includes an intermediate transfer belt 14, a second transfer roller 15, and a fixing unit 16. Toner images formed on the photoconductor drums 12 are successively first-transferred to the intermediate transfer belt. The second transfer roller 15 second-transfers the toner images transferred to the intermediate transfer belt 14 to the sheet P. The fixing unit 16 fixes the second-transferred toner images to the sheet P.

Around each photoconductor drum 12, a charger, a laser writing device, a developing unit, a cleaner, and the like are arranged. The charger charges the surface of the photoconductor drum 12. The laser writing device forms an electrostatic latent image on the surface of the photoconductor drum 12 by irradiating the surface with a laser beam. The developing unit develops the electrostatic latent image formed on the photoconductor drum 12 by using color toners to make the images visible. The cleaner removes residual toner remaining on the photoconductor drum 12 after the first transfer.

In the image forming unit 3, at the same time as the color toner images on the intermediate transfer belt 14 are transported to the position of the second transfer roller 15, the sheet P is supplied from the sheet feeding unit 5 to the second transfer roller 15. Thus, due to the action of a transfer electric field formed by the second transfer roller 15, the color toner images are simultaneously electrostatically transferred to the sheet P.

Subsequently, the sheet P, to which the color toner images are transferred, is peeled off the intermediate transfer belt 14 and transferred to the fixing unit 16. The fixing unit 16 fixes the color toner images to the sheet P by performing a fixing operation using heat and pressure, and a color image is formed on the sheet P. The sheet P, on which the color image is formed, is output from the image forming apparatus 1 by the sheet transport unit 6 and transported to the postprocessing apparatus 2, which is connected to the image forming apparatus 1.

The image forming method used by the image forming unit 3 is not limited to the electrophotographic method described above. Other methods, such as an inkjet method, may be used. Description of Sheet Cutting Unit 70

Next, the sheet cutting unit 70 according to the present exemplary embodiment will be described. As illustrated in FIG. 1, the sheet cutting unit 70 according to the present exemplary embodiment includes a cutter pair 71, a sheet press roller pair 72, and a roller shaft 73. The cutter pair 71 cuts one sheet P at a time by using a pair of blades. The sheet press roller pair 72 transports the sheet P and nips and presses the sheet P when the cutter pair 71 cuts the sheet P. The roller shaft 73 supports the cutter pair 71 and the sheet press roller pair 72. The sheet cutting unit 70 further includes a cutter pair drive motor 74 that moves the cutter pair 71.

Figure 2:
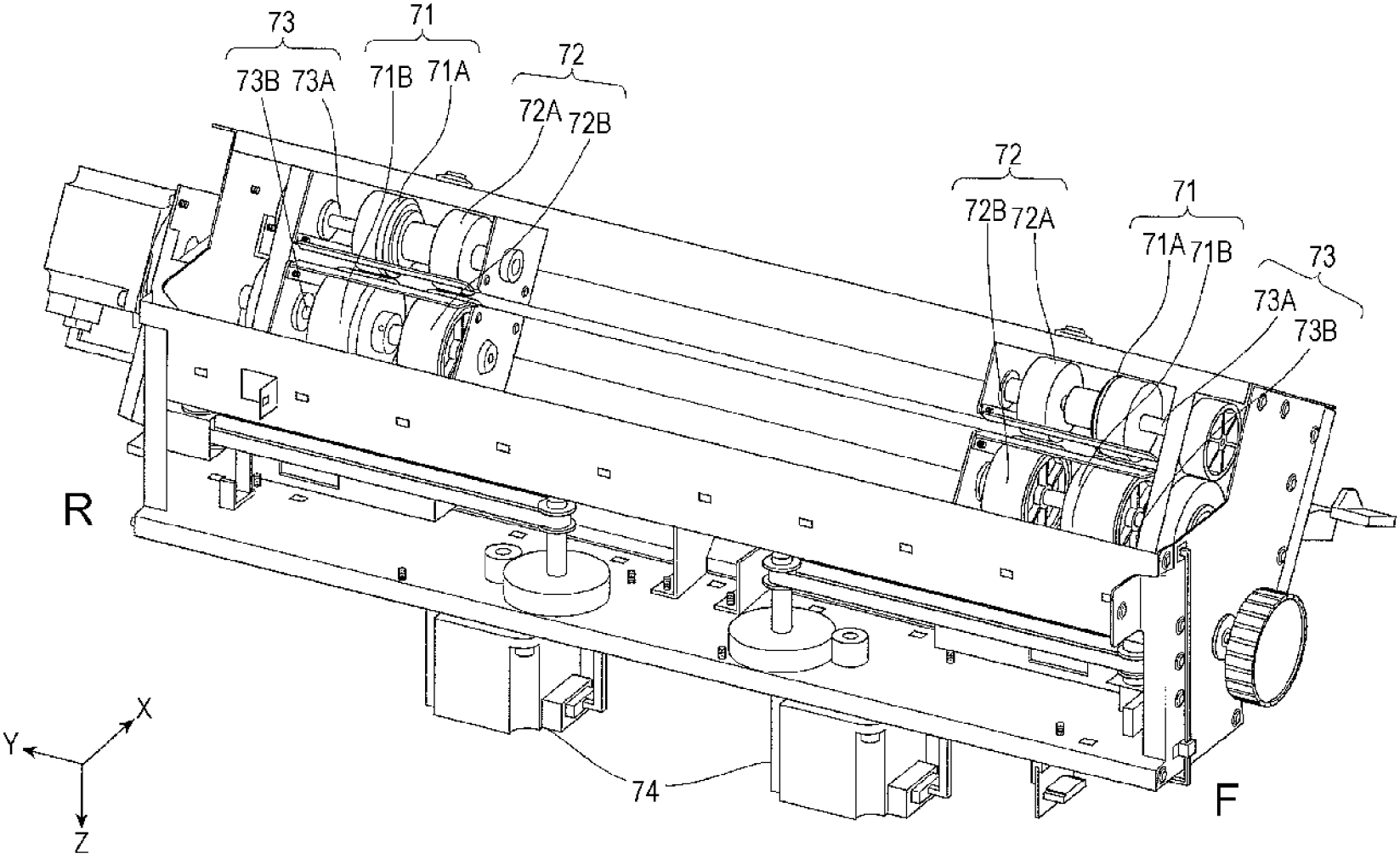
FIG. 2 is a perspective view illustrating the internal structure of a sheet cutting unit.

FIG. 2 is a perspective view illustrating the internal structure of the sheet cutting unit 70 according to the present exemplary embodiment. The cutter pair 71, which is an example of a cutting unit, is disposed on each of the front side F and the rear side R in FIG. 2. Each cutter pair 71 includes an upper cutter 71A, which is located above a sheet transport path, and a lower cutter 71B, which faces the upper cutter 71A and is located below the sheet transport path. Each of the upper cutter 71A and the lower cutter 71B are rotatable and has a blade along the peripheral edge thereof. A rotary driving unit (not shown) rotates the upper cutter 71A counterclockwise and the lower cutter 71B clockwise, as viewed from the front side F. The upper and lower cutters 71A and 71B cut the sheet P by nipping and pressing the sheet P therebetween. The cutter pair 71 on the front side F cuts an end portion of the sheet P on the front side F, and the cutter pair 71 on the rear side R cuts an end portion of the sheet P on the rear side R.

When cutting the sheet P, the cutter pair 71 pushes the sheet P in the X direction in FIG. 2, which is downstream in the transport direction. In other words, the cutter pair 71 not only cuts the sheet P but also transports the sheet P. In the present exemplary embodiment, the cutter pair 71 cuts one sheet P at a time. Therefore, the efficiency in cutting the sheet P is not reduced, and the sheet cutting unit 70 is reduced in the size and in power consumption.

The sheet press roller pair 72 is disposed on each of the front side F and the rear side R in FIG. 2. Both sheet press roller pairs 72 are disposed between the cutter pair 71 on the front side F and the cutter pair 71 on the rear side R. Each sheet press roller pair 72 includes an upper roller 72A, which is located above a sheet transport path, and a lower roller 72B, which faces the upper roller 72A and is located below the sheet transport path. A rotary driving unit (not shown) rotates the upper roller 72A counterclockwise and the lower roller 72B clockwise, as viewed from the front side F. Thus, the sheet press roller pair 72 transports the sheet P in the X direction while nipping the sheet P when the cutter pair 71 cuts the sheet P.

The roller shaft 73 is disposed on each of the front side F and the rear side R so as to extend in the Y direction in FIG. 2. The roller shaft 73 serves as the rotation shaft of the cutter pair 71 and the sheet press roller pair 72. Each roller shaft 73 includes an upper roller shaft 73A, which supports the upper cutter 71A and the upper roller 72A, and a lower roller shaft 73B, which supports the lower cutter 71B and the lower roller 72B. The upper roller shaft 73A on the front side F supports the upper cutter 71A and the upper roller 72A on the front side F. The lower roller shaft 73B on the front side F supports the lower cutter 71B and the lower roller 72B on the front side F. The upper roller shaft 73A on the rear side R supports the upper cutter 71A and the upper roller 72A on the rear side R. The lower roller shaft 73B on the rear side R supports the lower cutter 71B and the lower roller 72B on the rear side R.

The cutter pair drive motor 74 is disposed on each of the front side F and the rear side R. The cutter pair drive motor 74 on the front side F drives the cutter pair 71 on the front side F. The cutter pair drive motor 74 on the rear side R drives the cutter pair 71 on the rear side R. The cutter pairs 71, which are driven by the cutter pair drive motors 74, reach the positions at which the cutter pairs 71 cut the sheet P by moving in the Y direction and in the −Y direction.

Description of Finisher Unit 80

Next, the finisher unit 80 according to the present exemplary embodiment will be described. As illustrated in FIG. 1, the finisher unit 80 according to the present exemplary embodiment includes a sheet transport unit 81 and a binding unit 82. The sheet transport unit 81 transports the sheet P to a position where alignment of the sheet is performed. The binding unit 82 aligns the sheet P every time the sheet P is transported and binds a sheet stack of sheets P that are aligned. The finisher unit 80 further includes a controller 95. The controller 95 obtains information about the sheet P and information about a postprocessing operation to be performed on the sheet P from the image forming system 100, and controls the sheet cutting unit 70 and the finisher unit 80 on the basis of the obtained information.

Figure 3:
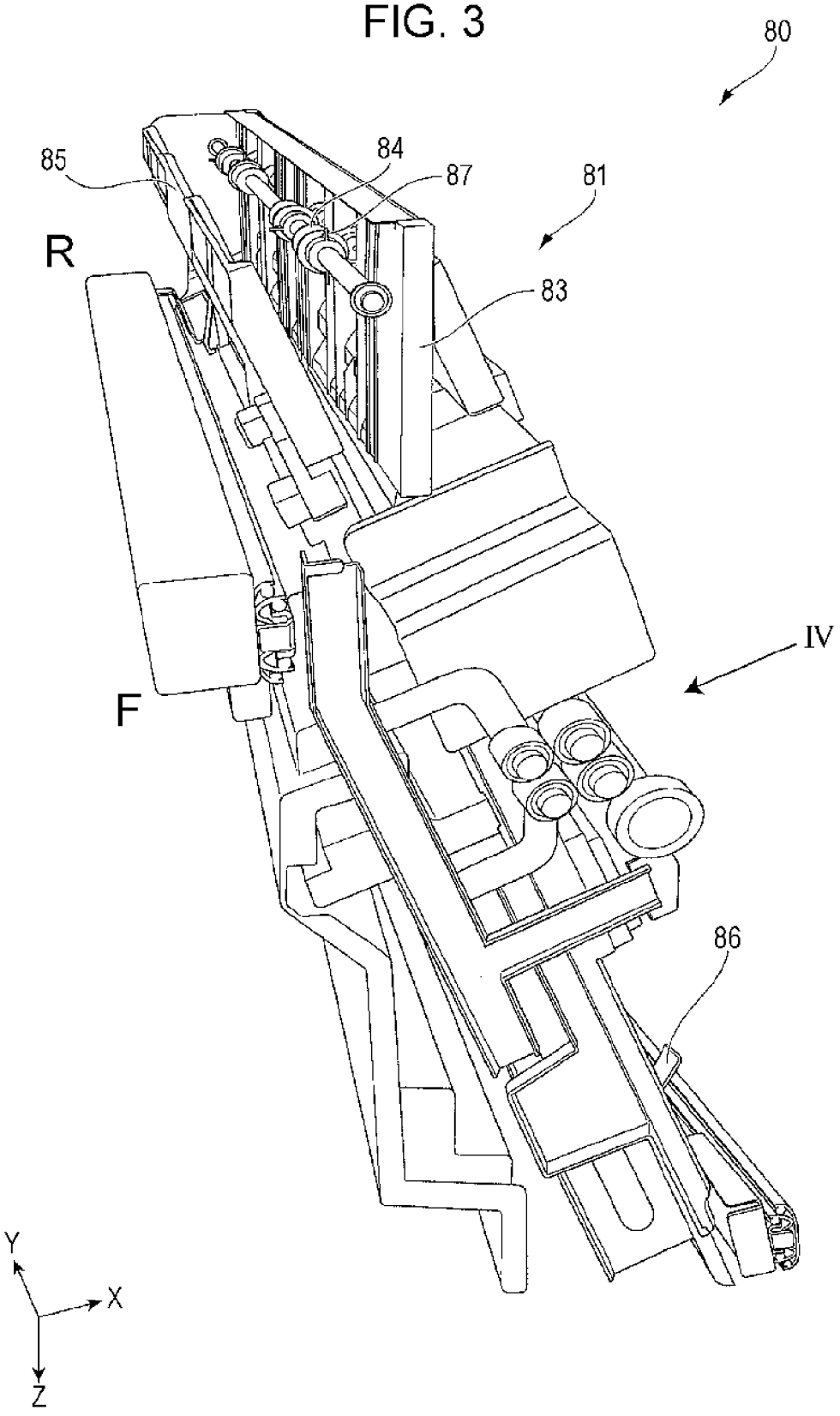
FIG. 3 is a perspective view of a finisher unit as viewed from a front side F.
Figure 4:
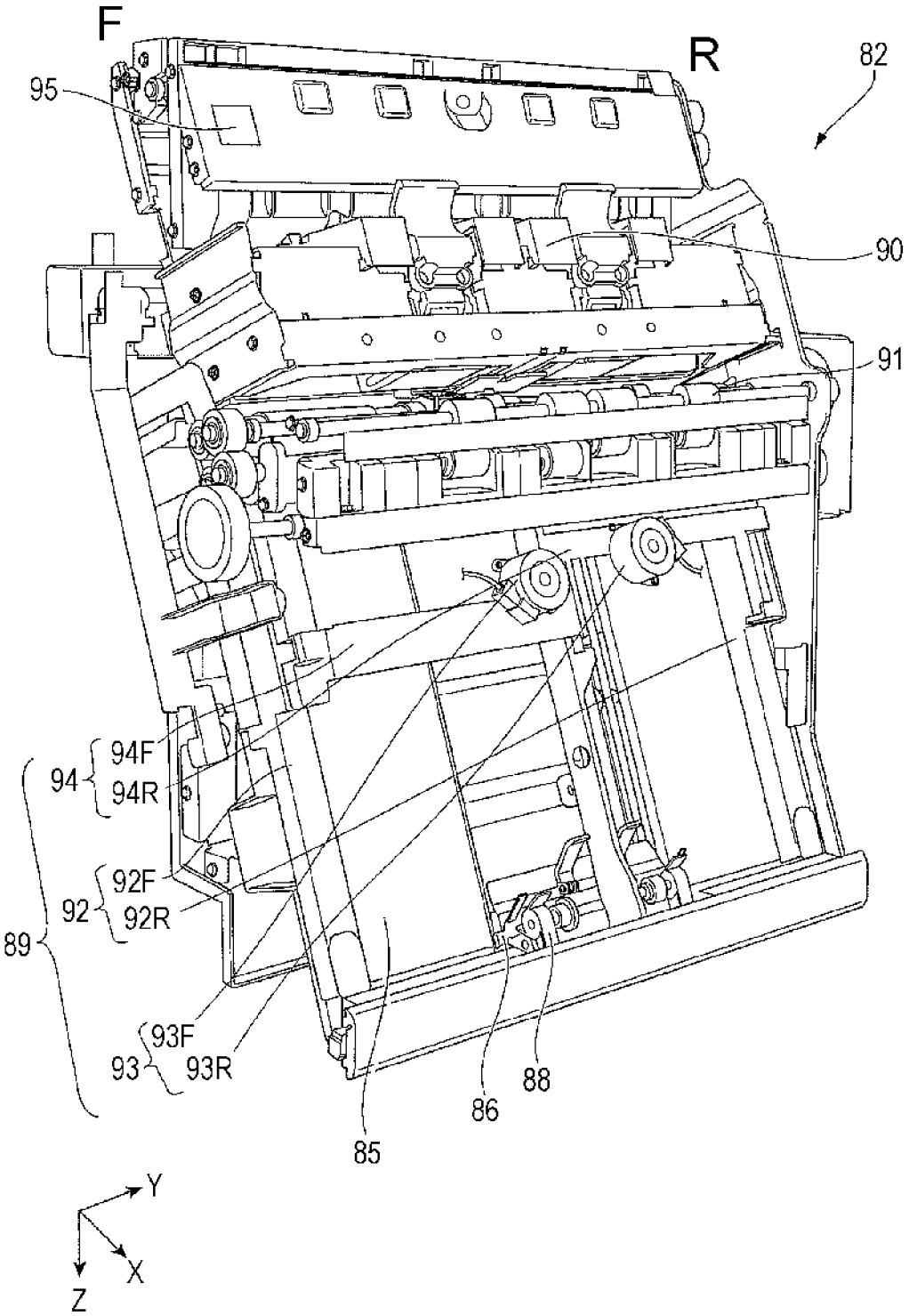
FIG. 4 is a perspective view of the finisher unit as viewed from the −X direction.

FIGS. 3 and 4 illustrate the internal structure of the finisher unit 80 according to the present exemplary embodiment. FIG. 3 is a perspective view of the finisher unit 80 as viewed from the front side F. FIG. 4 is a perspective view of the finisher unit 80 as viewed in a direction IV in FIG. 3.

The sheet transport unit 81 includes a sheet guide 83, a transport roller 84, and a compile tray 85. The sheet guide 83 guides the sheet P. The transport roller 84 is disposed on a rotation shaft and, by rotating, transports the sheet P that has reached the sheet guide 83 in the Z direction, which is downstream in the transport direction. The sheet P transported by the transport roller 84 is stacked on the compile tray 85. The sheet transport unit 81 further includes an end guide 86 and a sheet moving paddle 87. The end guide 86 restricts movement of the sheet P in the Z direction beyond a predetermined position on the compile tray 85. The sheet moving paddle 87 is coaxial with the transport roller 84 and has protrusions that protrude outward in the radial direction of the rotation shaft. As the protrusions rotate, the sheet moving paddle 87 hooks an end of the sheet P, which has reached the end guide 86, in the −Z direction and thereby moves the sheet P to the compile tray 85.

The sheet guide 83 is a transport path of the sheet P, which extends in the Z direction and is inclined with respect to the X direction.

The transport roller 84 nips the sheet P between the transport roller 84 and the sheet guide 83 and rotates clockwise as viewed from the front side F, and thereby transports the sheet P in the Z direction. In the present exemplary embodiment, the sheet press roller pair 72 of the sheet cutting unit 70 and the transport roller 84 are examples of a transport unit, which transports the cut sheet P to the compile tray 85.

The compile tray 85, which is an example a stacking unit, extends in the Z direction and is inclined with respect to the X direction. The compile tray 85 supports the sheet P transported by the transport roller 84. The compile tray 85 stacks the sheets P one by one and forms a stack of sheets P on the compile tray 85.

The end guide 86 and the compile tray 85 support the sheet P. The end guide 86 is movable along the compile tray 85. The position of the end guide 86 is adjusted so that the end guide 86 restricts movement of the sheet P in the Z direction at a position at which an end of the sheet P in the −Z direction is hooked to the protrusions of the sheet moving paddle 87.

When a sheet position sensor (not shown) detects that the sheet P has reached the end guide 86, the sheet moving paddle 87 rotates clockwise as viewed from the front side F, which is in the same as the direction in which the transport roller 84 rotates. Thus, the protrusions of the sheet moving paddle 87 are hooked to the end of the sheet P in the −Z direction, and thereby the entirety of the sheet P is moved to the compile tray 85. Accordingly, the sheet moving paddle 87 moves the sheet P, which has reached the finisher unit 80, from the sheet guide 83, and thereby suppresses occurrence of a paper jam, which may occur due to interference between the sheet P that has reached the end guide 86 and a sheet P newly transported to the sheet guide 83.

The binding unit 82 includes a sheet aligning paddle 88 and a sheet width aligning unit 89. To the end guide 86, the sheet aligning paddle 88 aligns an end, in in the Z direction, of the sheet P transported to the compile tray 85 by the sheet transport unit 81. The sheet width aligning unit 89 aligns, in the width direction, the sheet P that has been by the end guide 86 and the sheet aligning paddle 88 in the transport direction (longitudinal direction). The binding unit 82 further includes a stapler 90 and an output unit 91. The stapler 90 binds the sheet stack aligned by the sheet width aligning unit 89. The output unit 91 outputs the sheet stack bound by the stapler 90.

The sheet aligning paddle 88 rotates counterclockwise as viewed from the front side F. The sheet aligning paddle 88 presses the end of the sheets P in the Z direction, the sheet P, which is transported one by one by the sheet transport unit 81 to the compile tray 85, against the end guide 86, and thereby aligns the sheets P in the longitudinal direction.

The sheet width aligning unit 89 includes a tamper 92, a tamper drive motor 93, and a rack gear 94. The tamper 92, which is movable in the Y direction and the −Y direction, aligns the sheet P in the width direction. The tamper drive motor 93 moves the tamper 92. The rack gear 94, which extends in the Y direction, supports the tamper 92 and guides movement of the tamper 92 in the Y direction and −Y direction.

The tamper 92, which is an example of a recording medium aligning unit, includes a tamper 92F on the front side F and a tamper 92R on the rear side R. Each of the tamper 92F and the tamper 92R has a rectangular shape extending in the Z direction along the surface of the compile tray 85 for stacking the sheet P. Each of the tamper 92F and the tamper 92R is inclined in the X direction. The tamper 92F and the tamper 92R have shapes that are symmetric to each other and are controlled independently. The tamper 92 includes a pinion gear (not shown) that is rotated by the tamper drive motor 93. The tamper 92 moves when the pinion gear, which is rotated by the tamper drive motor 93, meshes with the rack gear 94, which supports the pinion gear at a height at about half the height of the tamper 92.

The tamper 92F, which is disposed at an end portion of the compile tray 85 on the front side F, approaches the sheet P by moving in the Y direction, and then parallelly comes into contact with the front side F of the sheet P. The tamper 92F moves in the Y direction while being in contact with the sheet P, and thereby moves the sheet P on the compile tray 85 in the Y direction. The tamper 92R, which is disposed at an end portion of the compile tray 85 on the rear side R, approaches the sheet P by moving in the −Y direction, and then parallelly comes into contact with the rear side R of the sheet P. The tamper 92R moves the sheet P on the compile tray 85 in the −Y direction.

The tamper 92R restricts the movement of the sheet P in the Y direction caused by the tamper 92F, and the tamper 92F restricts the movement of the sheet P in the −Y direction caused by the tamper 92R. As a result, the position of the sheet P in the Y direction is determined. Subsequently, the tamper 92F moves in the −Y direction and the tamper 92R moves in the Y direction, and the tamper 92 waits for the next sheet P to be transported to the compile tray 85.

Thus, the tamper 92 approaches the sheet P from both sides and comes into contact with the sheet P, moves the sheet P, and then separates from the sheet P. By doing so, the tamper 92 performs an operation of aligning the sheet P, which is transported to the compile tray one by one, in the width direction.

The tamper 92 may perform the operation of aligning the sheet P in the width direction plural times each time the sheet P is stacked on the compile tray 85. By performing the operation of aligning the sheet P in the width direction plural times, the sheet P is more precisely aligned in the width direction. The compile tray 85 and the tamper 92 are examples of a recording medium aligning apparatus.

The tamper drive motor 93 includes a motor 93F that moves the tamper 92F and a motor 93R that moves the tamper 92R.

The rack gear 94 includes a rack gear 94F and a rack gear 94R. The rack gear 94F is disposed on the front side F of the compile tray 85 and guides the movement of the tamper 92F. The rack gear 94R is disposed on the rear side R of the compile tray 85 and guides the movement of the tamper 92R. The rack gear 94 meshes with the pinion gear of the tamper 92 and guides the movement of the tamper 92 in the Y direction and in the −Y direction.

The stapler 90, which is an example of a binding unit, staples an end portion or a middle portion of a sheet stack that has been in the longitudinal direction and in the width direction. The cutter pair 71, the sheet press roller pair 72, the transport roller 84, the compile tray 85, the tamper 92, and the stapler 90 are examples of a recording medium binding apparatus.

The output unit 91 outputs the sheet stack, stapled by the stapler 90, to a container tray (not shown). When the middle portion of the sheet stack is stapled by the stapler 90, the output unit 91 folds the sheet stack along a middle portion thereof and then outputs the sheet stack to the container tray.

Description of Functional Structure of Controller 95

Figure 5:
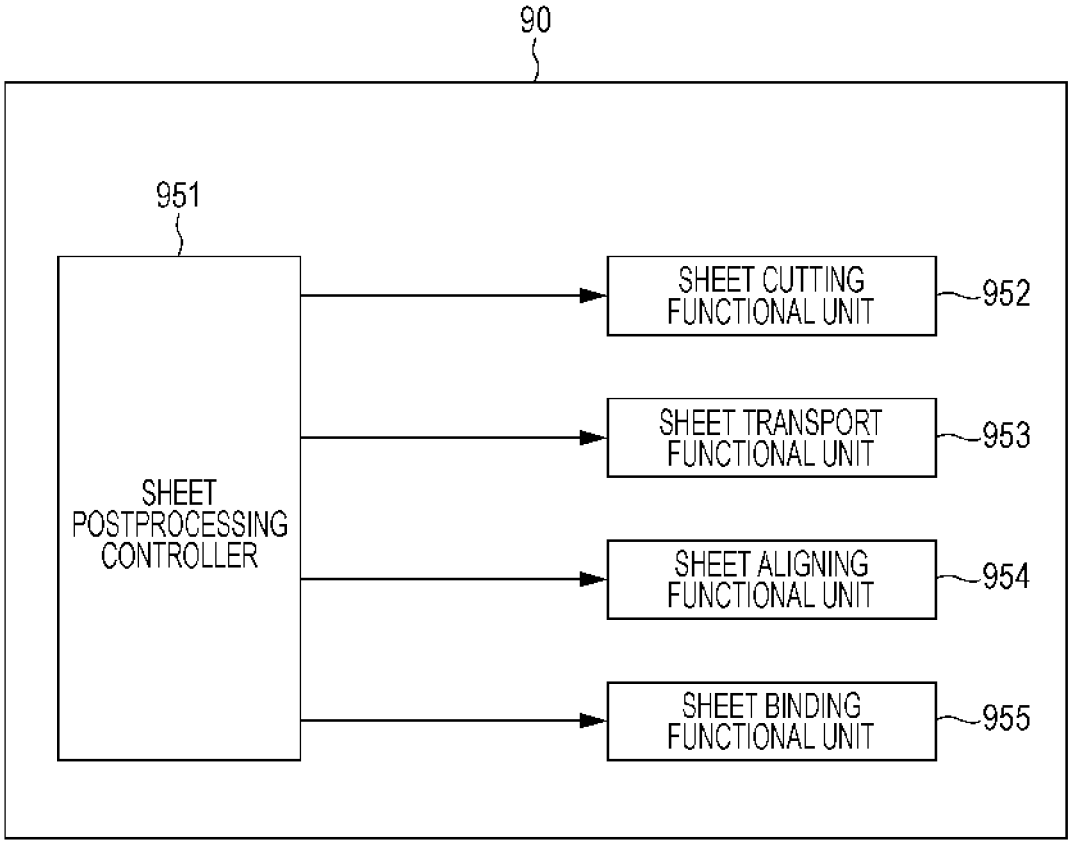
FIG. 5 is a block diagram showing the functional structure of a controller.

Next, the functional structure of the controller 95 of the finisher unit 80 will be described. FIG. 5 is a block diagram illustrating the functional structure of the controller 95.

The controller 95 includes a sheet postprocessing controller 951, a sheet cutting functional unit 952, and a sheet transport functional unit 953. The sheet postprocessing controller 951 obtains information about the sheet P and information about postprocessing operations to be performed on a sheet P from the image forming apparatus controller 8 of the image forming apparatus 1. The sheet cutting functional unit 952 controls the sheet cutting unit 70 to cut the sheet P. The sheet transport functional unit 953 controls the sheet transport unit 81 to transport the cut sheet P to the compile tray 85. The controller 95 further includes a sheet aligning functional unit 954 and a sheet binding functional unit 955. The sheet aligning functional unit 954 controls the compile tray 85 to align the sheet P every time the sheet P is transported to the compile tray 85. The sheet binding functional unit 955 controls the stapler 90 to staple a sheet stack that has been aligned, and then controls the sheet stack to be output to the output tray.

To each of the functional units 952, 953, 954, and 955, the sheet postprocessing controller 951 sends information about the sheet P and information about postprocessing operations to be performed on the sheet P, which are obtained from the image forming apparatus controller 8, and information specified by a user by using the image forming apparatus 1.

The sheet cutting functional unit 952 obtains information about the size and the sheet P and information about the amount of cut from the sheet postprocessing controller 951. In accordance with the obtained information, the sheet cutting functional unit 952 controls the cutter pair 71 to move to a position at which the sheet P is to be cut before the sheet P reaches the cutter pair 71. Moreover, the sheet cutting functional unit 952 controls the sheet press roller pair 72 to hold the sheet P and controls the cutter pair 71 to cut the sheet P.

The sheet transport functional unit 953 controls the sheet transport unit 81 to transport the sheet P to the compile tray 85. Moreover, the sheet transport functional unit 953 controls the end guide 86 to move in accordance with the size of the sheet P so that the trailing end of the sheet P in the −Z direction engages with the rotating sheet moving paddle 87 when the sheet P reaches the compile tray 85.

The sheet aligning functional unit 954 controls the sheet aligning paddle 88 to align, in the length direction, the sheet P that has reached the end guide 86; and controls the sheet width aligning unit 89 to align the sheet P in the width direction. From the sheet postprocessing controller 951, the sheet aligning functional unit 954 obtains information about the size of the sheet P to be aligned, information about the amount of cut, and information about a position at which stapling is to be performed. In accordance with the obtained information, the sheet aligning functional unit 954 controls the tamper 92 to align the sheet P in the width direction so as to set the position of the sheet P on the compile tray 85 in the Y direction.

On the basis of information about the position of the sheet P obtained from the sheet postprocessing controller 951, the sheet aligning functional unit 954 controls the tamper 92 to move beforehand to approach a predetermined position before the sheet P reaches the end guide 86. Thus, for example, as compared with a case where the tamper 92 moves after the sheet P has been transported to the compile tray 85, the time required for aligning the sheet P in the width direction is reduced. One of the tamper 92F and the tamper 92R of the tamper 92 may move beforehand or both of these may move beforehand. The sheet aligning functional unit 954 may control the tamper 92 to move after the sheet P has reached the end guide 86 instead of controlling the tamper 92 to move beforehand.

Moreover, the sheet aligning functional unit 954 controls the sheet width aligning unit 89 to align the sheet P in the width direction with different operations in accordance with information about the size of the sheet P, information about whether the sheet P to be aligned has been cut, and information about the number of the sheets P to be stacked on the compile tray 85, which are obtained from the sheet postprocessing controller 951. Each of the operations performed by the sheet width aligning unit 89 will be described below in detail.

The sheet binding functional unit 955 obtains information about the size of the sheet P and the position at which the sheet stack is to be bound from the sheet postprocessing controller 951. In accordance with the obtained information, the sheet binding functional unit 955 controls the stapler 90 to staple the sheet stack aligned by the sheet width aligning unit 89 and controls the output unit 91 to output the stapled sheet stack to the output tray.

First Example of Operation of Sheet Width Aligning Unit 89

Figure 6:
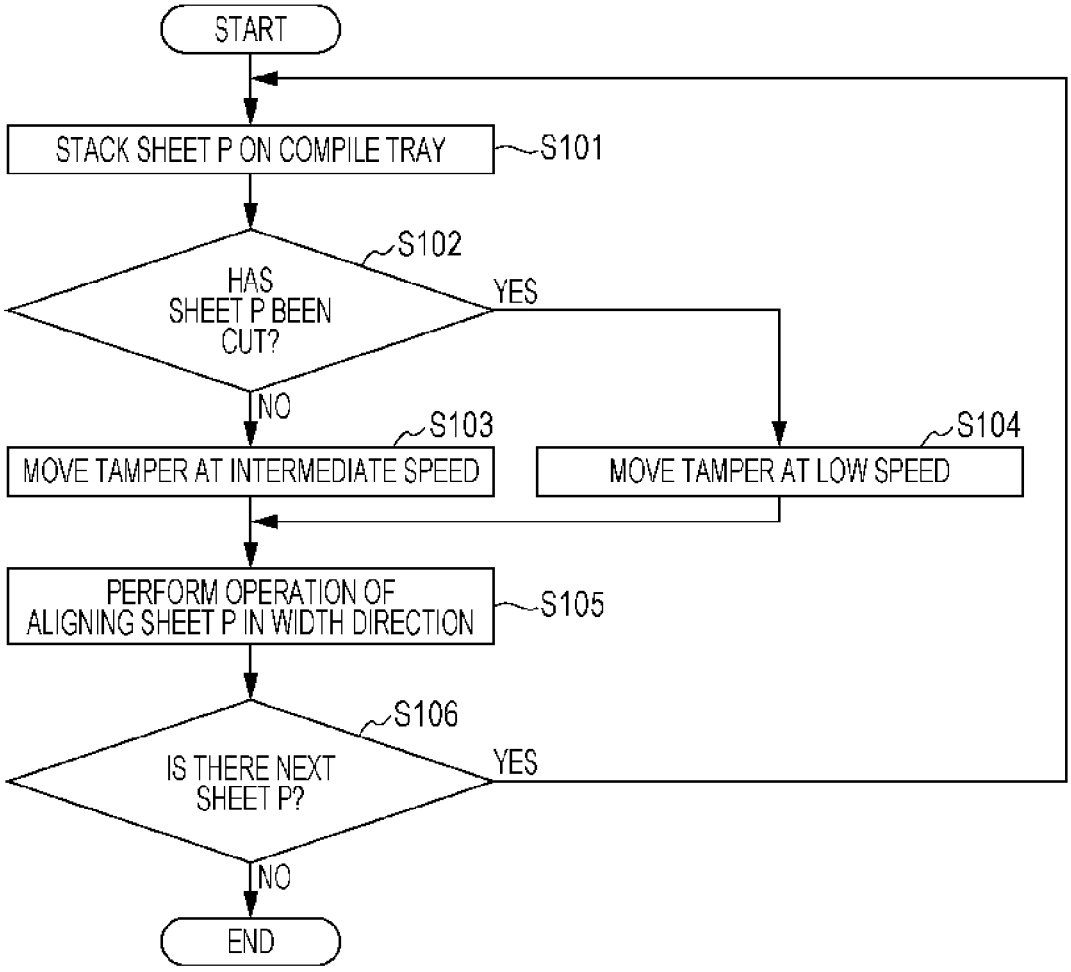
FIG. 6 is a flowchart showing an example of the operation of a sheet width aligning unit.

Next, a first example of an operation performed by the sheet width aligning unit 89 to align the sheet P in the width direction will be described. FIG. 6 is a flowchart showing the first example of the operation performed by the sheet width aligning unit 89. In the first example, according to whether the sheet P has been cut, the sheet width aligning unit 89 performs different operations. First, when the sheet P transported to the finisher unit 80 is stacked on the compile tray 85 (step S101), the sheet aligning functional unit 954 checks whether the sheet P has been cut by the sheet cutting unit 70 on the basis of information obtained from the sheet postprocessing controller 951 (step S102). If the sheet P has not been cut ("NO" in step S102), the tamper 92 of the sheet width aligning unit 89 moves at an "intermediate speed" (step S103). The term "intermediate speed" refers a speed that a user may set at any appropriate beforehand.

If the sheet P has been cut by the sheet cutting unit 70 ("YES" in step S102), the tamper 92 moves at a speed different from that of the case where the sheet P has not been cut. The sheet width aligning unit 89 performs this operation in consideration of trouble that may occur when an end portion of the sheet P in the width direction is cut by the cutter pair 71 of the sheet cutting unit 70.

In the sheet cutting unit 70, the sheet press roller pair 72 suppresses movement of the sheet P in the width direction when cutting the sheet P. However, due to resilience of the sheet P that is pressed, the sheet P might become displaced in the width direction. If this occurs, the amount of cut in the width direction may vary between the start and the end of cutting the sheet P. If such a sheet P, whose width is not uniform in the longitudinal direction, is stacked on the compile tray 85, the tamper 92 might not parallelly come into contact with the ends of the sheet P in the width direction. As a result, the precision with which the sheet width aligning unit 89 aligns the sheet P in the width direction might decrease. Moreover, the sheet P may come into contact with only a part of the tamper 92, and therefore the sheet P might become deformed or damaged.

Therefore, in the present exemplary embodiment, in the case where the sheet P has been cut by the sheet cutting unit 70, the tamper 92 is moved at a "low speed" that is lower than that of the case where the sheet P has not been cut (step S104). Then, the tamper 92 aligns the sheet P in the width direction at a speed that is set according to whether the sheet P has been cut (step S105). Thus, the cut sheet P is aligned with a higher precision while suppressing deformation or damage of the sheet P.

After aligning the sheet P in the width direction, the sheet aligning functional unit 954 checks whether there is the next sheet P to be stacked on the compile tray 85 (step S106). If the next sheet P to be stacked on the compile tray 85 has been transported ("YES" in step S106), after stacking the next sheet P on the compile tray 85 (step S101), the subsequent steps are repeatedly performed. If the next sheet P is not transported ("NO" in step S106), the sheet width aligning unit 89 finishes the operation of aligning the sheet P in the width direction.

Second Example of Operation of Sheet Width Aligning Unit 89

Figure 7:
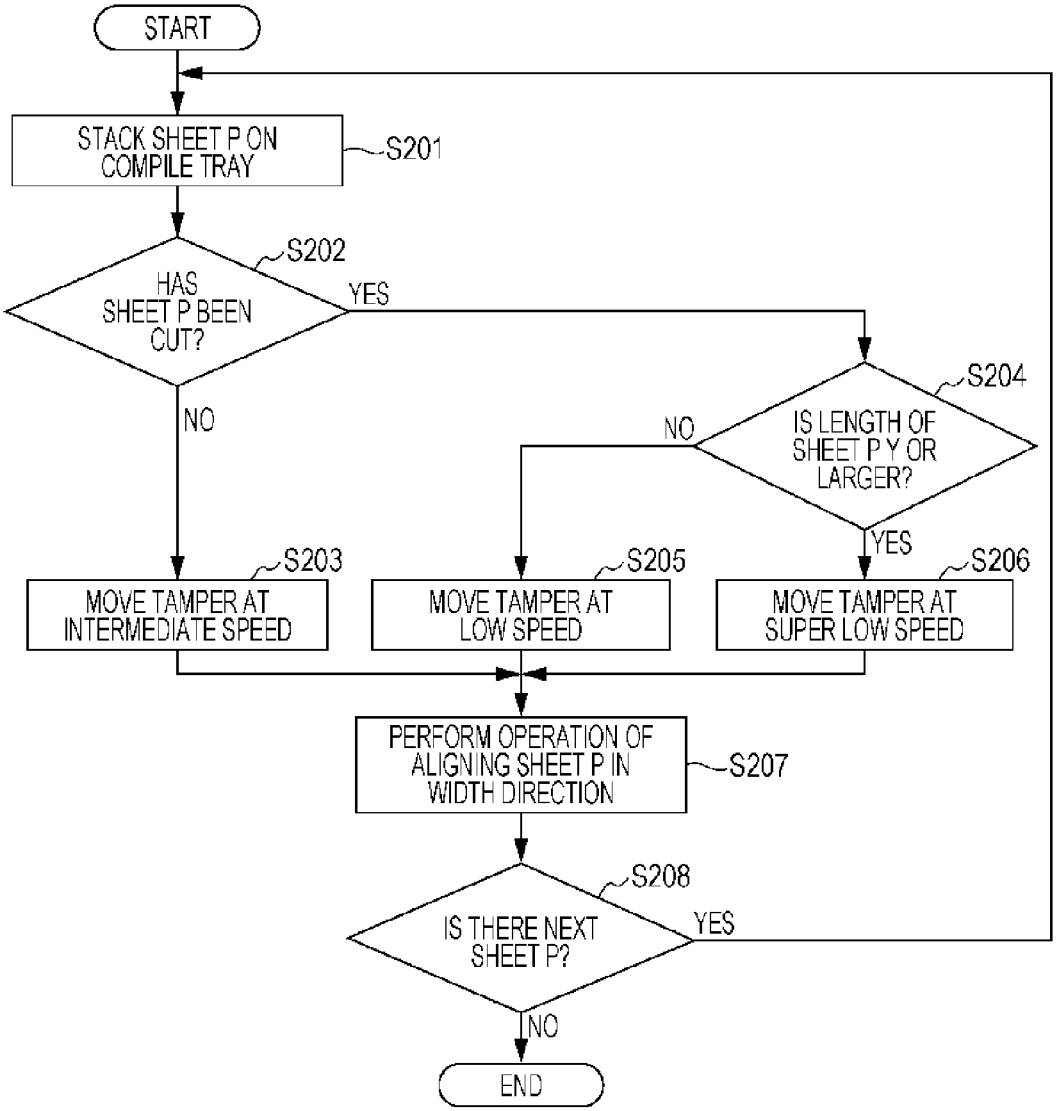
FIG. 7 is a flowchart showing another example of the operation of the sheet width aligning unit.

Next, a second example of an operation performed by the sheet width aligning unit 89 to align the sheet P in the width direction, which is different from the first example shown in FIG. 6, will be described. FIG. 7 is a flowchart showing the second example of the operation performed by the sheet width aligning unit 89. As described below, according to whether the length of the cut sheet P is a predetermined length or larger, the sheet width aligning unit 89 performs an operation that differs from that shown in FIG. 6.

When the sheet P transported to the finisher unit 80 is stacked on the compile tray 85 (step S201), the sheet aligning functional unit 954 checks whether the sheet P has been cut (step S202). If the sheet P has not been cut ("NO" in step S202), the tamper 92 of the sheet width aligning unit 89 moves at an "intermediate speed" (step S203). If the sheet P has been cut ("YES" in step S202), the sheet aligning functional unit 954 checks whether the length of the sheet P is a predetermined length Y or larger (step S204). Here, Y is a threshold corresponding to, for example, the length of an A3-size sheet. A user may set Y at any appropriate value beforehand.

If the length of the cut sheet P is smaller than Y ("NO" in step S204), the tamper 92 moves at a "low speed", which is lower than the "intermediate speed" (step S205).

If the length of the cut sheet P is comparatively large, variation in the amount by which the sheet P has been cut by the sheet cutting unit 70 may become larger with respect to the longitudinal direction of the sheet P.

Therefore, if the length of the cut sheet P is Y or larger ("YES" in step S204), the tamper 92 moves at a "super low speed", which is lower than the "low speed" (step S206). The tamper 92 aligns the sheet P in the width direction at a speed that is set according to whether the sheet P has been cut and in accordance with the length of the sheet P (step S207).

After aligning the sheet P in the width direction, the sheet aligning functional unit 954 checks whether there is the next sheet P to be stacked on the compile tray 85 (step S208). If the next sheet P to be stacked on the compile tray 85 has been transported ("YES" in step S208), after stacking the next sheet P on the compile tray 85 (step S201), the subsequent steps are repeatedly performed. If the next sheet P is not transported ("NO" in step S208), the sheet width aligning unit 89 finishes the operation of aligning the sheet P in the width direction.

Third Example of Operation of Sheet Width Aligning Unit 89

Figure 8:
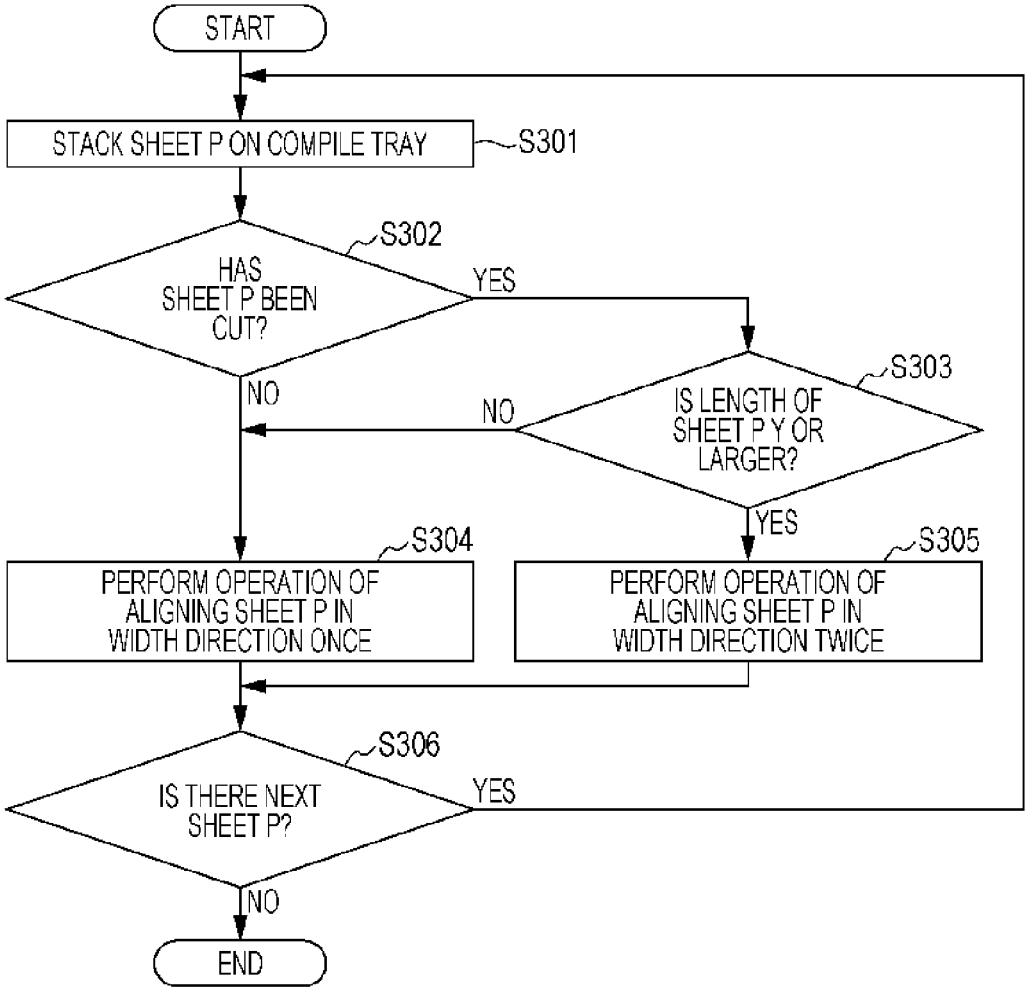
FIG. 8 is a flowchart showing another example of the operation of the sheet width aligning unit.

Next, a third example of an operation performed by the sheet width aligning unit 89 to align the sheet P in the width direction, which is different from the first and second examples shown in FIGS. 6 and 7, will be described. FIG. 8 is a flowchart showing the third example of the operation performed by the sheet width aligning unit 89. As described below, according to whether the length of the cut sheet P is a predetermined length or larger, the sheet width aligning unit 89 performs an operation that further differs from that shown in FIG. 7.

When the sheet P transported to the finisher unit 80 is stacked on the compile tray 85 (step S301), the sheet aligning functional unit 954 checks whether the sheet P has been cut (step S302). If the sheet P has been cut ("YES" in step S302), the sheet aligning functional unit 954 checks whether the length of the sheet P is a predetermined length Y or larger (step S303). Here, Y is a threshold corresponding to, for example, the length of an A3-size sheet. A user may set Y at any appropriate value beforehand.

If the sheet P has not been cut ("NO" in step S302) or if the length of the cut sheet P is smaller than Y ("NO" in step S303), the tamper 92 performs an operation of aligning the sheet P in the width direction once (step S304). Here, it is assumed that the tamper 92 performs the operation of aligning the sheet P in the width direction once by approaching and contacting the sheet P, moving the sheet P, and then separating from sheet P.

If the length of the cut sheet P is comparatively large, the distances between sheets that are successively transported are comparative long, and therefore the period from the time at which the sheet P reaches the end guide 86 to the time the next sheet P is transported to the compile tray 85 is comparatively long. In this case, even if the operation of aligning the sheet P in the width direction is performed plural times, the next sheet P that is transported toward the compile tray 85 does not stop to wait for the end of the operation of aligning the sheet P that has reached the end guide 86.

Therefore, if the length of the cut sheet P is Y or larger ("YES" in step S303), the tamper 92 performs the operation of aligning the sheet P in the width direction twice (step S305).

After aligning the sheet P in the width direction, the sheet aligning functional unit 954 checks whether there is the next sheet P to be stacked on the compile tray 85 (step 306). If the next sheet P to be stacked on the compile tray 85 has been transported ("YES" in step S306), after stacking the next sheet P on the compile tray 85 (step S301), the subsequent steps are repeatedly performed. If the next sheet P is not transported ("NO" in step S306), the sheet width aligning unit 89 finishes the operation of aligning the sheet P in the width direction.

Fourth Example of Operation of Sheet Width Aligning Unit 89

Figure 9:
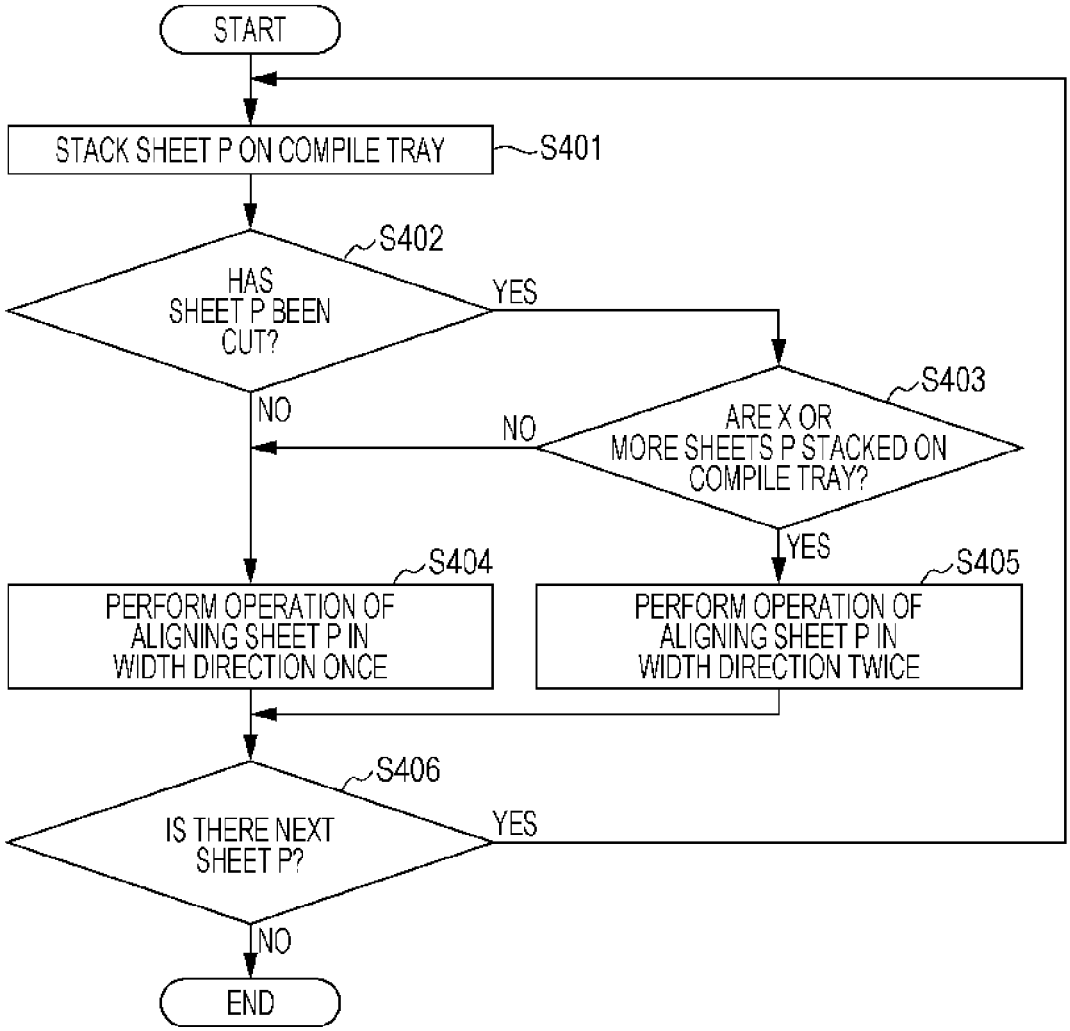
FIG. 9 is a flowchart showing another example of the operation of the sheet width aligning unit.

Next, a fourth example of an operation with which the sheet width aligning unit 89 aligns the sheet P in the width direction, which is different from the first to third examples shown in FIGS. 6 to 8, will be described. FIG. 9 is a flowchart showing the fourth example of the operation performed by the sheet width aligning unit 89. As described below, when aligning the cut sheet P in the width direction, according to whether the number of the sheets P stacked on the compile tray 85 is a predetermined number or larger, the sheet width aligning unit 89 performs different operations.

When the sheet P transported to the finisher unit 80 is stacked on the compile tray 85 (step S401), the sheet aligning functional unit 954 checks whether the sheet P has been cut (step S402). If the sheet P has been cut ("YES" in step S402), the sheet aligning functional unit 954 checks whether the number of the sheets P stacked on the compile tray 85 is a predetermined number X or larger (step S403) on the basis of information obtained from the sheet post-processing controller 951. Here, X is a threshold having, for example, a value 5. A user may set X at any appropriate value beforehand.

If the sheet P has not been cut ("NO" in step S402) or if the number of the sheets P that are staked on the compile tray 85 is smaller than 5 ("NO" in step S403), the tamper 92 performs an operation of aligning the sheet P in the width direction once (step S404).

If plural cut sheets P are stacked on the compile tray 85, a load that the sheet P receives from the tamper 92 when the tamper 92 aligns the sheet P in the width direction is distributed to the stacked sheets P. Therefore, the sheet P is not likely to become deformed or damaged when the operation of aligning the sheet P in the width direction is performed.

Therefore, if the number of the cut sheets P stacked on the compile tray 85 is 5 or larger ("YES" in step S403), the tamper 92 performs the operation of aligning the sheet P in the width direction twice (step S405).

After aligning the sheet P in the width direction, the sheet aligning functional unit 954 checks whether there is the next sheet P to be stacked on the compile tray 85 (step 406). If the next sheet P to be stacked on the compile tray 85 has been transported ("YES" in step S406), after stacking the next sheet P on the compile tray 85 (step S401), the subsequent steps are repeatedly performed. If the next sheet P is not transported ("NO" in step S406), the sheet width aligning unit 89 finishes the operation of aligning the sheets P in the width direction.

As heretofore described, in the present exemplary embodiment, when aligning the cut sheet P in the width direction, the tamper 92 comes into contact with the sheet P at a lower speed than when aligning the sheet P that has not been cut. Thus, only a part of the sheet P comes into contact with the tamper 92 when being aligned, and therefore deformation or damage of the sheet P is suppressed. When aligning the cut sheet P in the width direction, the tamper 92 separates from the sheet P, with which the tamper has been in contact, at a lower speed than when aligning the sheet P that has not been cut. Thus, when the tamper 92 separates from the sheet P, the degree to which the sheets P become misaligned from each other due to a reactional force of the sheets P, which may occur due to a load that the sheets P receive from the tamper 92 with which the sheets P have been in contact, is reduced.

When aligning the sheet P that has been cut and that has a predetermined length or larger, the tamper 92 performs the operation of aligning the sheet P in the width direction at a lower speed than when aligning the sheet P that has been cut and that has a length smaller than the predetermined length. Thus, the sheets P that tend to be misaligned from each other are aligned with a higher precision.

When aligning the sheet P that has been cut and that has a predetermined length or larger, the tamper 92 performs the operation of aligning the sheet P in the width direction more times than when aligning the sheet P that has been cut and that has a length smaller than a predetermined length. Thus, postprocessing of the cut sheet P is performed with a higher precision without decreasing the efficiency of postprocessing.

Moreover, when aligning the cut sheet P in the width direction, the tamper 92 performs the operation of aligning the sheet P in the width direction more times in a case where the number of the sheets P stacked on the compile tray 85 is a predetermined number or larger than in a case where the number of the sheets P stacked on the compile tray 85 is smaller than the predetermined number. Thus, sheet alignment is performed with a higher precision while suppressing occurrence of deformation or damage of the cut sheet P.

In the present exemplary embodiment, the tamper 92 moves at the "low speed" when aligning the cut sheet P in width direction. The tamper 92 may move at any speed, as long as the speed is lower than the speed at which the tamper aligns, in the width direction, the sheet P that has not been cut. Likewise, the "super low speed" may be any speed lower than the "low speed".

When aligning the sheet P that has been cut and that has a predetermined length or larger, the tamper 92 performs the operation of aligning the sheet P in the width direction twice. The tamper 92 may perform the operation any times as long as it is more than that of a case where the tamper 92 aligns the sheet P that has been cut and that has a length smaller than the predetermined length. Plural thresholds, each of which is a predetermined length, may be set, and the number of times the operation of aligning the sheet P is performed may be change between different values in accordance with the length of the sheet P. The same applies to the number of times the tamper 92 performs a sheet alignment operation in accordance with the number of the sheets P stacked on the compile tray 85.

The sheet width aligning unit 89 may perform a combination of the operations described in the present exemplary embodiment.

For example, irrespective of the length of the sheet P and the number of the sheets P stacked on the compile tray 85, when aligning the sheet P that has been cut, the tamper 92 may perform the sheet aligning operation more times than when aligning the sheet P that has not been cut. Also in this case, the sheet P is aligned with a higher precision.

When aligning the sheet P that has been cut and that has a predetermined length or larger, the tamper 92 may perform an operation of aligning the sheet P in the width direction at a lower speed than when aligning, in the width direction, the sheet P that has not been cut and more times than when aligning the sheet P having a predetermined length or smaller. The same applies to a sheet aligning operation that the tamper 92 performs in accordance with the number of sheets P stacked on the compile tray 85.

When aligning the cut sheet P in the width direction, if number of the sheets P stacked on the compile tray 85 is a predetermined number or larger and the length of the sheets P is a predetermined length or smaller, the tamper 92 moves at a lower speed than when aligning, in the width direction, the sheet P that has not been cut. Furthermore, the tamper 92 may perform the sheet aligning operation more times than in a case where the number of the sheets P stacked on the compile tray 85 is a predetermined number or larger and the length of the sheet P is smaller than a predetermined length or in the case where the number of the sheets P stacked on the compile tray 85 is smaller than a predetermined number and the length of the sheet P is a predetermined length or larger.

In the present exemplary embodiment, a staple binding is performed on a stack of sheets that are aligned. However, the binding method is not limited to staple binding. For example, the sheet stack may be bound by applying an adhesive to the back (edge)of thereof, or the sheets P of the sheet stack may be joined to each other by applying a pressure in the thickness direction of the sheet stack (a direction that crosses the longitudinal direction and the width direction of the sheet stack).

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording medium binding apparatus comprising:

a cutting unit that is capable of cutting a first end and a second end of each of recording media, the second end facing the first end;

a transport unit that transports the recording media;

a stacking unit on which the recording media transported by the transport unit are stacked;

a recording medium aligning unit that aligns the recording media by pressing each recording medium by coming into contact with the first end and the second end of the recording medium every time the recording medium is stacked on the stacking unit, the recording medium aligning unit changing an operation of coming into contact with and separating from the recording medium when pressing the recording medium according to whether the recording medium has been cut or the recording medium has not been cut; and a binding unit that binds a recording medium stack formed by stacking the recording media aligned by the recording medium aligning unit.

2. The recording medium binding apparatus according to claim 1, wherein, when aligning the recording medium that has been cut, the recording medium aligning unit comes into contact with and separates from the recording medium at a lower speed than when aligning the recording medium that has not been cut.

3. The recording medium binding apparatus according to claim 2, wherein, when aligning the recording medium that has been cut, the recording medium aligning unit comes into contact with and separates from the recording medium more times than when aligning the recording medium that has not been cut.

4. The recording medium binding apparatus according to claim 2, wherein, when aligning the recording medium that has been cut and that has a predetermined length or larger, the recording medium aligning unit comes into contact with and separates from the recording medium at a lower speed than when aligning the recording medium that has been cut and that has a length smaller than the predetermined length.

5. The recording medium binding apparatus according to claim 2, wherein, when aligning the recording medium that has been cut and that has a predetermined length or larger, the recording medium aligning unit comes into contact with and separates from the recording medium more times than when aligning the recording medium that has been cut and that has a length smaller than the predetermined length.

6. The recording medium binding apparatus according to claim 2, wherein, when aligning the recording medium that has been cut, the recording medium aligning unit comes into contact with and separates from the recording medium more times in a case where the number of the recording media stacked on the stacking unit is a predetermined number or larger than in a case where the number of the recording media stacked on the stacking unit is smaller than the predetermined number.

7. The recording medium binding apparatus according to claim 1, wherein, when aligning the recording medium that has been cut, the recording medium aligning unit comes into contact with and separates from the recording medium more times than when aligning the recording medium that has not been cut.

8. The recording medium binding apparatus according to claim 7, wherein, when aligning the recording medium that has been cut and that has a predetermined length or larger, the recording medium aligning unit comes into contact with and separates from the recording medium at a lower speed than when aligning the recording medium that has been cut and that has a length smaller than the predetermined length.

9. The recording medium binding apparatus according to claim 1, wherein, when aligning the recording medium that has been cut and that has a predetermined length or larger, the recording medium aligning unit comes into contact with and separates from the recording medium at a lower speed than when aligning the recording medium that has been cut and that has a length smaller than the predetermined length.

10. The recording medium binding apparatus according to claim 1, wherein, when aligning the recording medium that has been cut and that has a predetermined length or larger, the recording medium aligning unit comes into contact with and separates from the recording medium more times than when aligning the recording medium that has been cut and that has a length smaller than the predetermined length.

11. The recording medium binding apparatus according to claim 1, wherein, when aligning the recording medium that has been cut, the recording medium aligning unit comes into contact with and separates from the recording medium more times in a case where the number of the recording media stacked on the stacking unit is a predetermined number or larger than in a case where the number of the recording media stacked on the stacking unit is smaller than the predetermined number.

12. A recording medium aligning apparatus comprising:

a stacking unit on which recording media, each having a first end and a second end facing the first end, are stacked; and a recording medium aligning unit that aligns the recording media, which are to form a recording medium stack to be bound, by pressing each recording medium by coming into contact with the first end and the second end of the recording medium every time the recording medium is stacked on the stacking unit, the recording medium aligning unit changing an operation of coming into contact with and separating from the recording medium when pressing the recording medium according to whether the recording medium has been cut or the recording medium has not been cut.

13. An image forming system comprising:

an image forming apparatus that forms images on recording media;

a cutting unit that is capable of cutting a first end and a second end of each of recording media on which an image has been formed by the image forming apparatus, the second end facing the first end;

a transport unit that transports the recording media;

a stacking unit on which the recording media transported by the transport unit are stacked;

a recording medium aligning unit that aligns the recording media by pressing each recording medium by coming into contact with the first end and the second end of the recording medium every time the recording medium is stacked on the stacking unit;

a binding unit that binds a recording medium stack formed by stacking the recording media aligned by the recording medium aligning unit; and a controller that causes the recording medium aligning unit to change an operation of coming into contact with and separating from the recording medium when pressing the recording medium according to whether the recording medium has been cut or the recording medium has not been cut.

* * * * *